US010783813B1

(12) United States Patent
Hamami

(10) Patent No.: US 10,783,813 B1
(45) Date of Patent: Sep. 22, 2020

(54) FLAG DISPLAY DEVICE

(71) Applicant: T. S. Hamami, Naples, FL (US)

(72) Inventor: T. S. Hamami, Naples, FL (US)

(73) Assignee: USFMD LLC, Naples, FL (US)

( * ) Notice: Subject to any disclaimer, the term of this patent is extended or adjusted under 35 U.S.C. 154(b) by 0 days.

(21) Appl. No.: 16/578,871

(22) Filed: Sep. 23, 2019

Related U.S. Application Data

(63) Continuation-in-part of application No. 16/503,507, filed on Jul. 4, 2019.

(51) Int. Cl.

| | |
|---|---|
| ***G09F 17/00*** | (2006.01) |
| ***G09F 7/08*** | (2006.01) |
| ***G09F 13/18*** | (2006.01) |
| ***B63B 45/04*** | (2006.01) |

(52) U.S. Cl.
CPC ..... *G09F 17/00* (2013.01); *B63B 45/04* (2013.01); *G09F 7/08* (2013.01); *G09F 13/18* (2013.01); *G09F 2017/005* (2013.01); *G09F 2017/0075* (2013.01)

(58) Field of Classification Search
CPC ..... G09F 17/00; G09F 2017/005; G09F 2017/0075; G09F 7/08; G09F 13/18; B63B 45/04
See application file for complete search history.

(56) References Cited

U.S. PATENT DOCUMENTS

| | | | | |
|---|---|---|---|---|
| 2,921,307 | A * | 1/1960 | Risk | H01Q 1/285 343/705 |
| 3,096,906 | A | 7/1963 | Chidsey, Jr. et al. | |
| 4,057,030 | A | 11/1977 | Womack | |
| 6,609,476 | B1 | 8/2003 | Lorenzana et al. | |
| 7,114,387 | B2 | 10/2006 | Omotani | |
| 10,344,924 | B1 * | 7/2019 | Ganahl | F21L 4/08 |
| 2004/0221495 | A1 | 11/2004 | Hogestad | |
| 2009/0151212 | A1 | 6/2009 | Cadavis | |
| 2012/0204455 | A1 * | 8/2012 | Mothaffar | G09F 13/22 40/610 |
| 2012/0260842 | A1 | 10/2012 | King | |

FOREIGN PATENT DOCUMENTS

| | | |
|---|---|---|
| CA | 2362624 | 5/2003 |

* cited by examiner

*Primary Examiner* — Stephen P Avila
(74) *Attorney, Agent, or Firm* — Bryan L. Loeffler, Esq.; Loeffler IP Group, P.A.

(57) ABSTRACT

A flag display device (1) used for fully displaying a flag regardless of the presence of wind and/or in the dark. The flag display device supports a preferably interchangeable display panel (3) extending between a top horizontal support arm (7) and a bottom horizontal support arm (8) that each extend perpendicularly from a vertical mast (4). At least one display light source (22) illuminates the display panel at night.

16 Claims, 12 Drawing Sheets

FLAG DISPLAY DEVICE

CROSS-REFERENCE TO RELATED APPLICATION

This application is a continuation-in-part of application Ser. No. 16/503,507 filed on Jul. 4, 2019, which is currently pending. The patent application identified above is incorporated herein by reference in its entirety to provide continuity of disclosure.

FIELD OF THE INVENTION

This invention relates generally to flags and devices for displaying flags and more particularly to a flag display device that fully displays a flag regardless of the presence of wind and/or sunlight.

BACKGROUND OF THE INVENTION

Conventional cloth and nylon flags are flown or displayed by attaching grommets located on an edge of a flag to hooks and rope supported by a vertical mast or flag pole. Flags, particularly the American flag, convey a powerful messages and provide an aesthetic beauty when wind is present and the flag is flying fully extended in all of its glory.

Unfortunately when wind is not present, conventional flags simply droop and fail to provide all of their intended benefits. An additional problem occurs at night when conventional flags are not visible due to darkness. Both wind and light are the two main requirements for properly displaying a conventional cloth flag.

Therefore, a need exists for a flag display device that fully displays a flag regardless of the presence of wind and/or in the dark.

SUMMARY OF THE INVENTION

The primary object of the present invention is to provide a flag display device that fully displays a flag regardless of the presence of wind and/or in the dark.

The present invention fulfills the above and other objects by providing a flag display device having a preferably teardrop-shaped vertical mast that is mountable to a surface, such as a surface of a boat, from where the vertical mast extends upward and terminates at a top end. A preferably teardrop-shaped top horizontal support arm extends perpendicularly from the vertical mast below the top end of said vertical mast. Likewise, a preferably teardrop-shaped bottom horizontal support arm extends perpendicularly from the vertical mast below the top horizontal support arm.

The top horizontal support arm and the bottom horizontal support arm are parallel to each other and are spaced apart to support at least one rigid or non-rigid display panel having a design located thereon wherein the design may be printed and/or at least one cutout forming said design. For example, the display panel may have an American flag printed on one or more surfaces. Likewise, the display panel may have an American flag design cutout so that negative spaces or cutout portions form the stars and stripes of the American flag.

The flag display device preferably has at least one display light source, such as an LED, located on a bottom surface of the top horizontal support and/or at least one display light source located on a top surface of the bottom horizontal support arm. The at least one display light source may be powered by a hard wired energy source and/or at least one rechargeable battery powered by at least one solar or photovoltaic panel. The at least one display light source may shine light onto an exterior surface of a display panel or shine light through the display panel from an interior space created when there are two display panels as described below.

The top horizontal support arm and bottom horizontal support arm may support two display panels that are spaced apart to provide space for at least one display light source to be positioned between the two display panels. The two display panels may be supported in positions that form a corresponding tear-drop shape with the top horizontal support arm and the bottom horizontal support arm. Said display panels may be translucent and/or have one or more cutouts to allow light pass through to illuminate the display panels at night.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
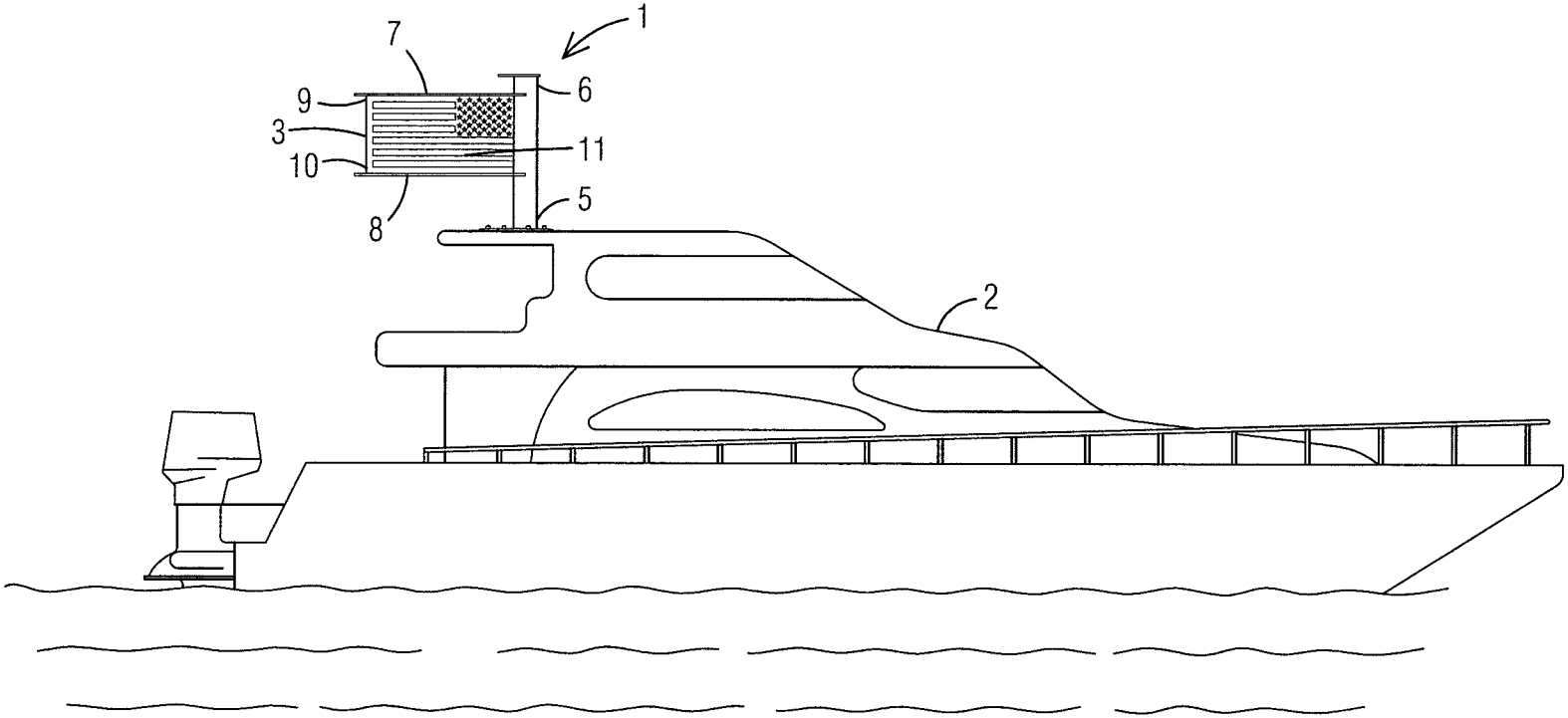
FIG. 1 is a side view of a flag display device of the present invention in use on a stationary boat with no wind present.
Figure 2:
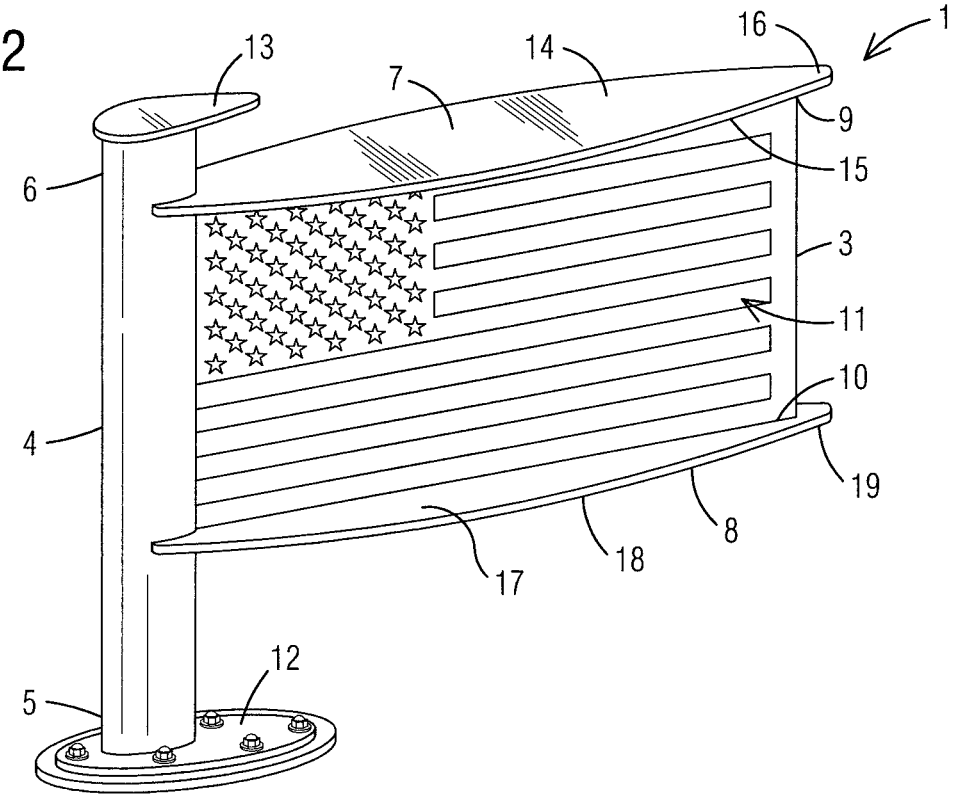
FIG. 2 is a front perspective view of the flag display device.
Figure 3:
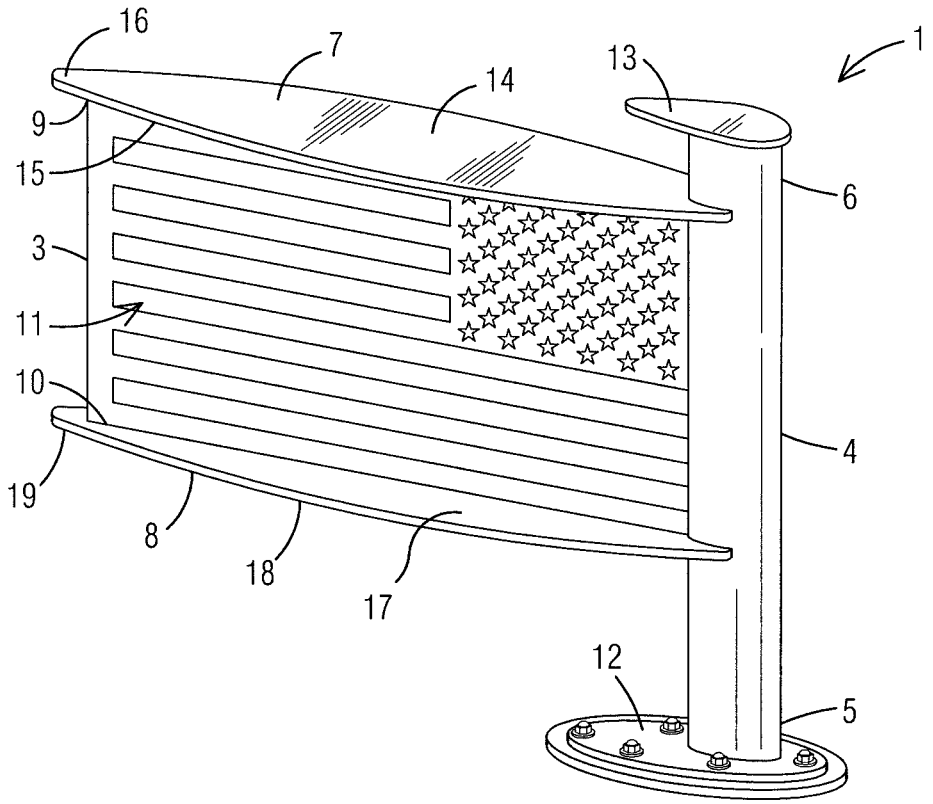
FIG. 3 is a rear perspective view of the flag display device thereof.
Figure 4:
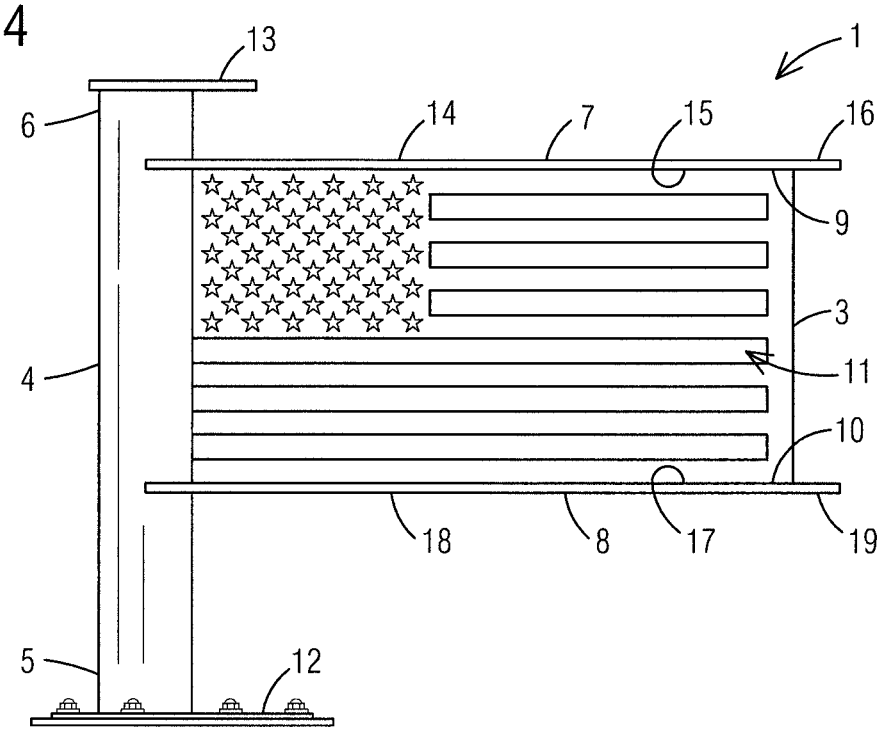
FIG. 4 is a right side view of the flag display device thereof.
Figure 5:
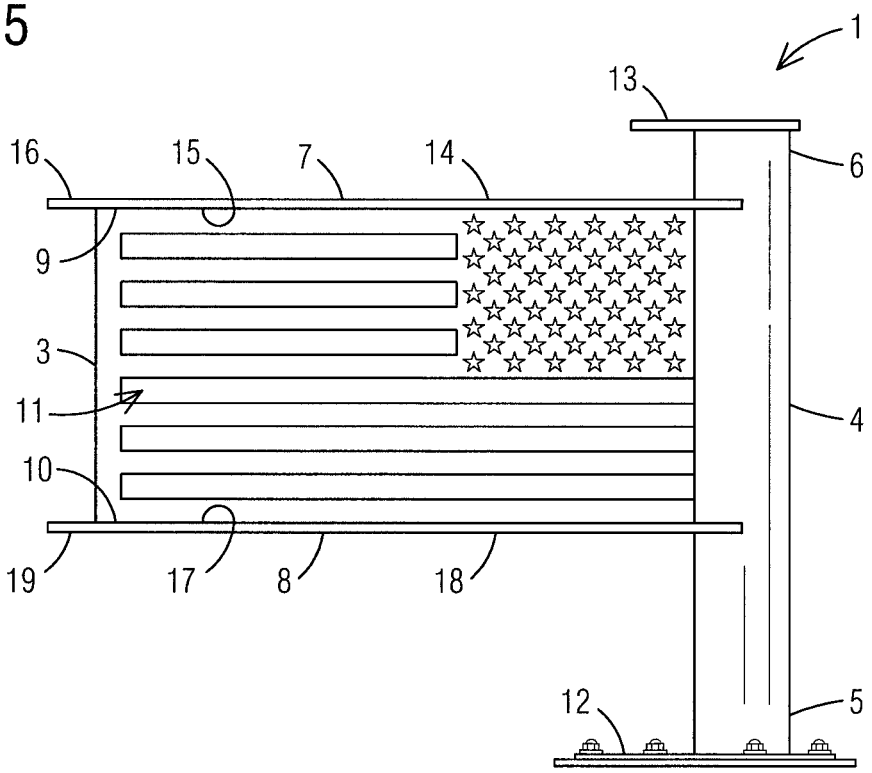
FIG. 5 is a left side view of the flag display device thereof.
Figure 6:
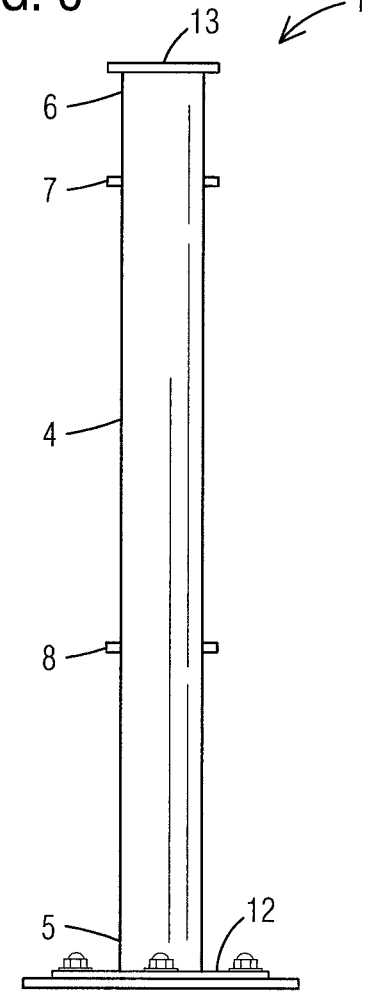
FIG. 6 is a front view of the flag display device thereof.
Figure 7:
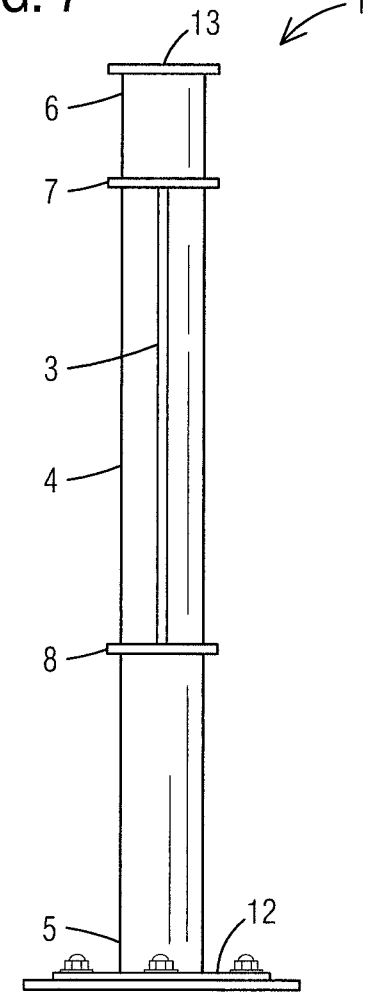
FIG. 7 is a rear view of the flag display device thereof.

For purposes of describing the preferred embodiment, the terminology used in reference to the numbered accessories in the drawings is as follows:

1. flag display device, generally
2. boat
3. display panel
4. vertical mast
5. bottom end of vertical mast
6. top end of vertical mast
7. top horizontal support arm
8. bottom horizontal support arm
9. top edge of display panel
10. bottom edge of display panel
11. design
12. bottom mounting plate
13. top mounting plate
14. top surface of top horizontal support arm
15. bottom surface of top horizontal support arm
16. distal end of top horizontal support arm
17. top surface of bottom horizontal support arm
18. bottom surface of bottom horizontal support arm
19. distal end of bottom horizontal support arm
20. attachment means
21. channel
22. display light source
23. solar panel
24. retaining means
25. navigation light
26. slot
27. battery
28. L-shaped bracket
29. tool box
30. horizontal plate
31. vertical plate
32. support arm
33. trailer hitch bracket
34. hitch shank With reference to FIG. 1, a side view of a flag display device 1 of the present invention in use on a stationary boat 2 with no wind present is illustrated. The flag display device 1 supports a preferably rigid rectangular-shaped display panel 3, having a flag or other design thereon, regardless of the presence of wind and/or in the dark. A bottom end 5 of a vertical mast 4 is mounted to a surface of the boat 2 and extends upward prior to terminating at a top end 6 thereof. At least one display panel 3 is supported between a top horizontal support arm 7 and a bottom horizontal support arm 8 that engage a top edge 9 of the at least one display panel 3 and a bottom edge 10 of the display panel 3, respectively. The at least one display panel 3 is preferably interchangeable to allow a user to select between multiple display panels 3 each having a unique flag, indicia or other design 11 being displayed thereon that is integrated into the display panel 3 and/or attachable to the display panel 3 via magnets or adhesive. As illustrated herein, the at least one display panel 3 comprises an American flag as the design 11 being presented. The design 11 on each display panel 3 may be magnetic overlays With reference to FIGS. 2-7, multiple views of a flag display device 1 of the present invention are illustrated. The flag display device 1 comprises a preferably teardrop-shaped vertical mast 4 having a bottom end 5 and a top end 6. A bottom mounting plate 12 is preferably located on the bottom end 5 of the vertical mast 4 to provide a means for mounting said vertical mast 4 to a mounting surface, such as a boat 2. A top mounting plate 13, such as a cap, is preferably located on the top end 6 of the vertical mast 4 to provide a means for mounting one or more accessories, to the top end 6 of the vertical mast 3, as further illustrated in FIG. 12.

A preferably teardrop-shaped top horizontal support arm 7 having a top surface 14 and a bottom surface 15 extends perpendicularly from the vertical mast 4 below the top end 6 of said vertical mast 4 and terminates at a distal end 16 thereof. Likewise, a preferably teardrop-shaped bottom horizontal support arm 8 having a top surface 17 and a bottom surface 18 extends perpendicularly from the vertical mast 4 below the top horizontal support arm 7 and terminates at a distal end 19 thereof.

The top horizontal support arm 7 and bottom horizontal support arm 8 are parallel to each other and are spaced apart to support at least one display panel 3 having a design 10 thereon wherein said design may be printed and/or the design may be formed from at least one cutout. Said at least one display panel 3 is preferably interchangeable and secured to the top horizontal support arm 7 and bottom horizontal support arm 8 via at least one attachment means 20, such as a channel 21 that engage the top edge 9 of the at least one display panel 3 and a bottom edge 10 of the display panel 3, respectively, as illustrated in FIG. 10.

Figure 8:
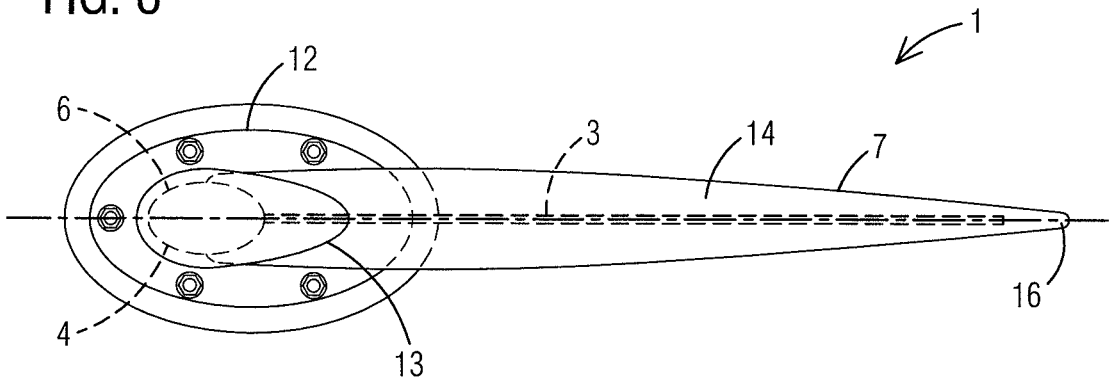
FIG. 8 is a top plan view of the flag display device thereof.

With reference to FIG. 8, a top plan view of a flag display device 1 of the present invention is illustrated. The vertical mast 4, top horizontal support arm 7 and bottom horizontal support arm 8 are each preferably substantially teardrop-shaped when looking a top profile or bottom profile. The teardrop-shape provides decreased wind resistance when the flag display device 1 is in motion on a boat 2 or other moving object.

Figure 9:
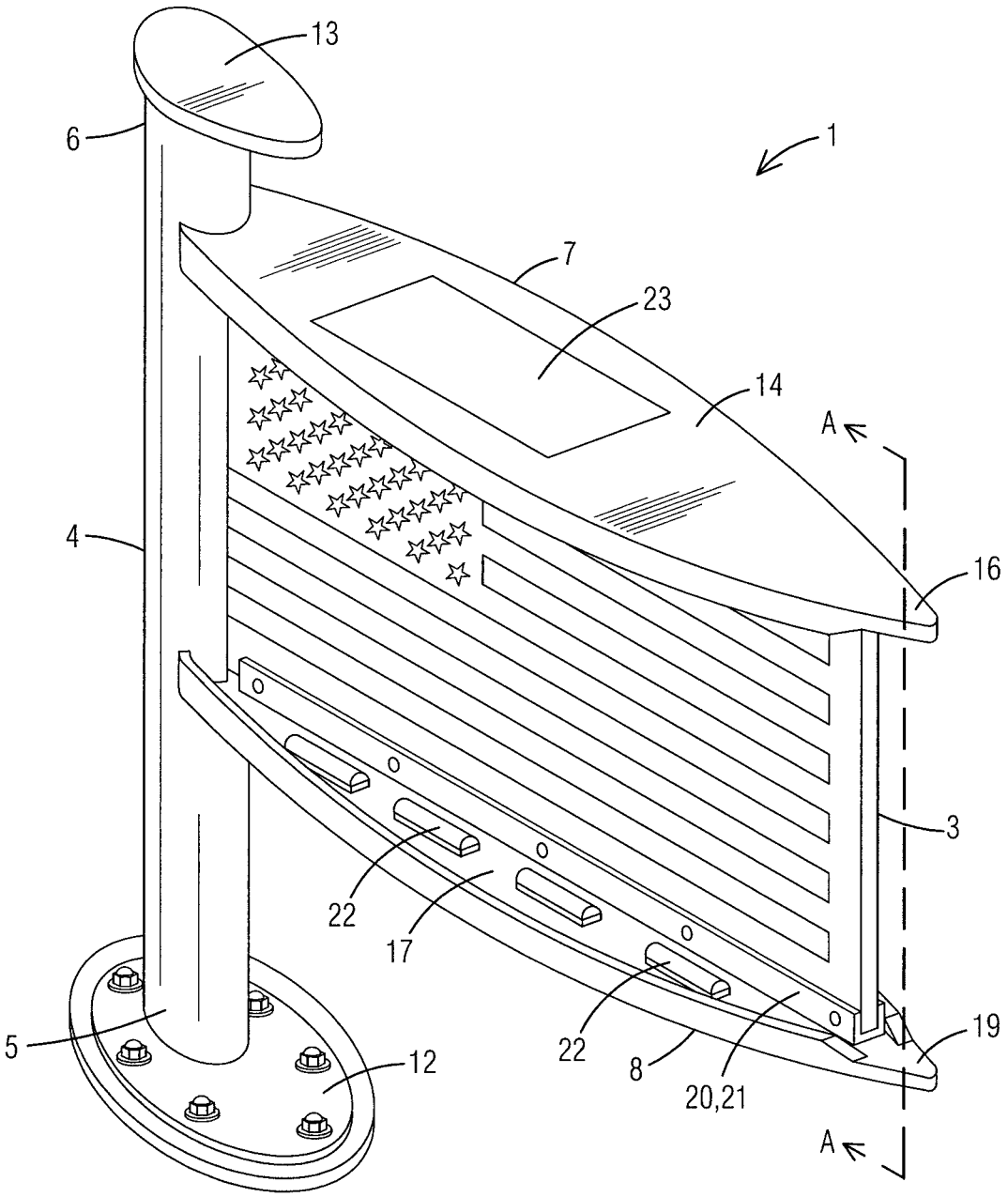
FIG. 9 is rear perspective view of the flag display device further illustrating a display light source and engagement of at least one rigid panel thereto.
Figure 10:
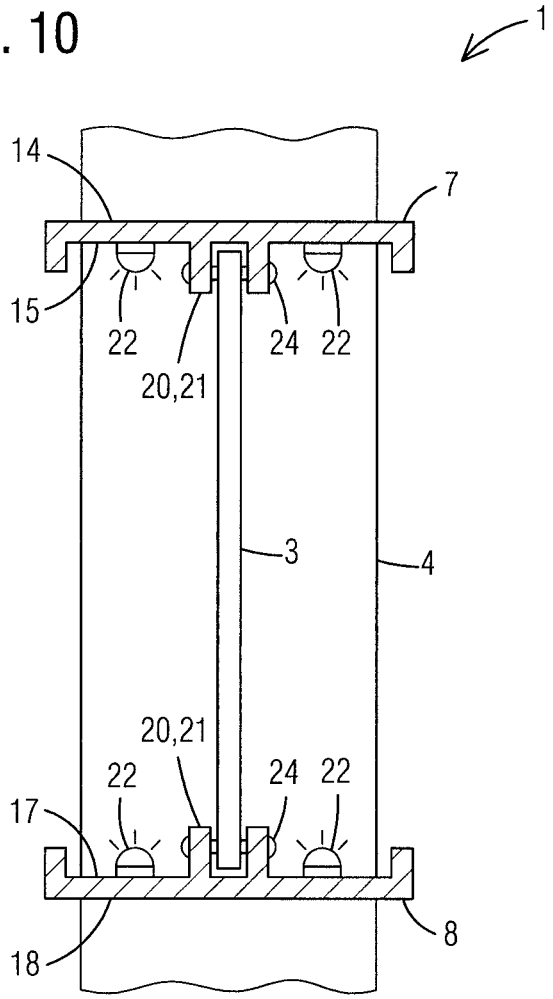
FIG. 10 is a sectional view along lines A-A of FIG. 9.
Figure 11:
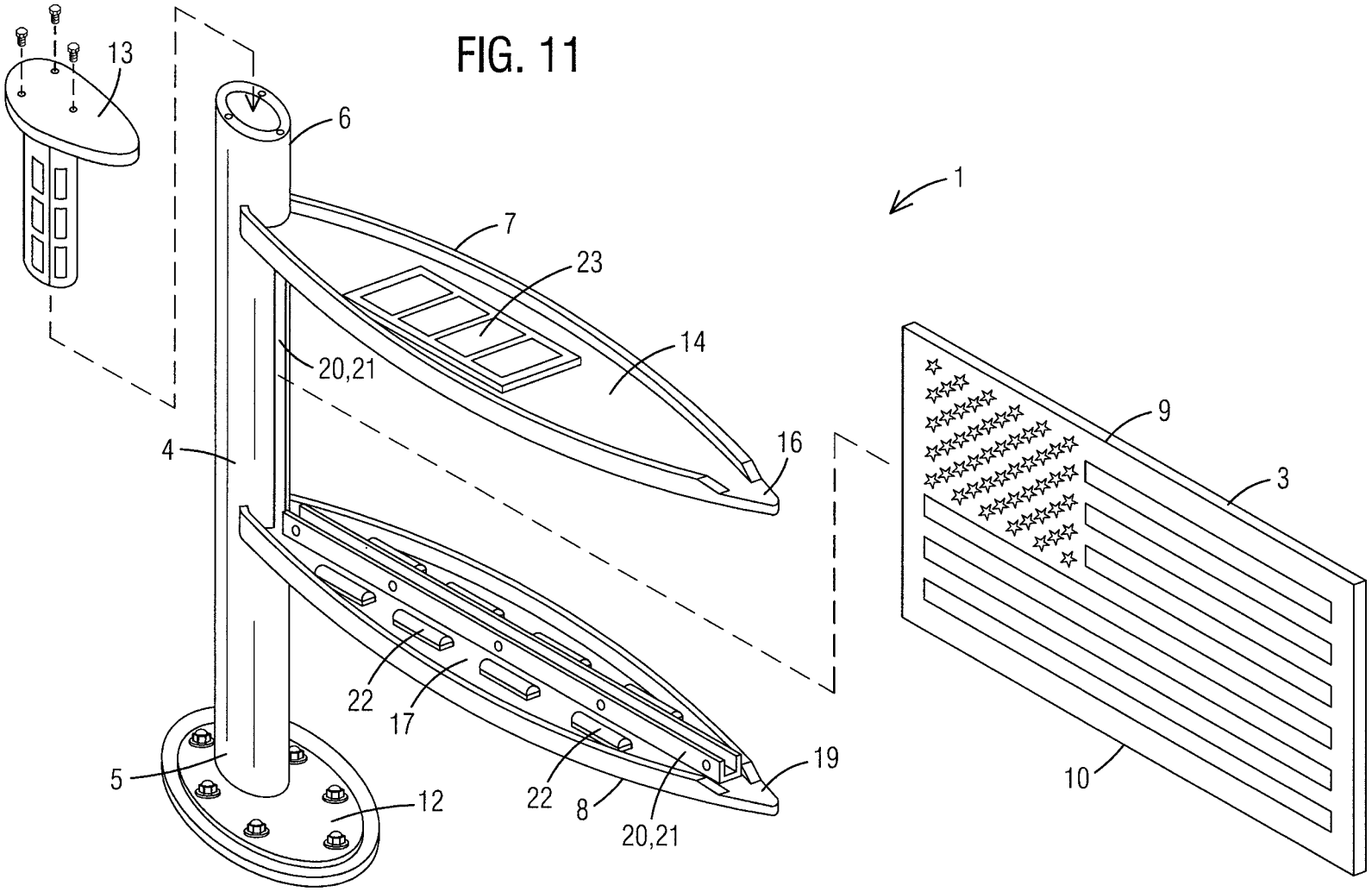
FIG. 11 is an exploded rear perspective view of the flag display device further illustrating a display light source and engagement of at least one rigid panel thereto.
Figure 12:
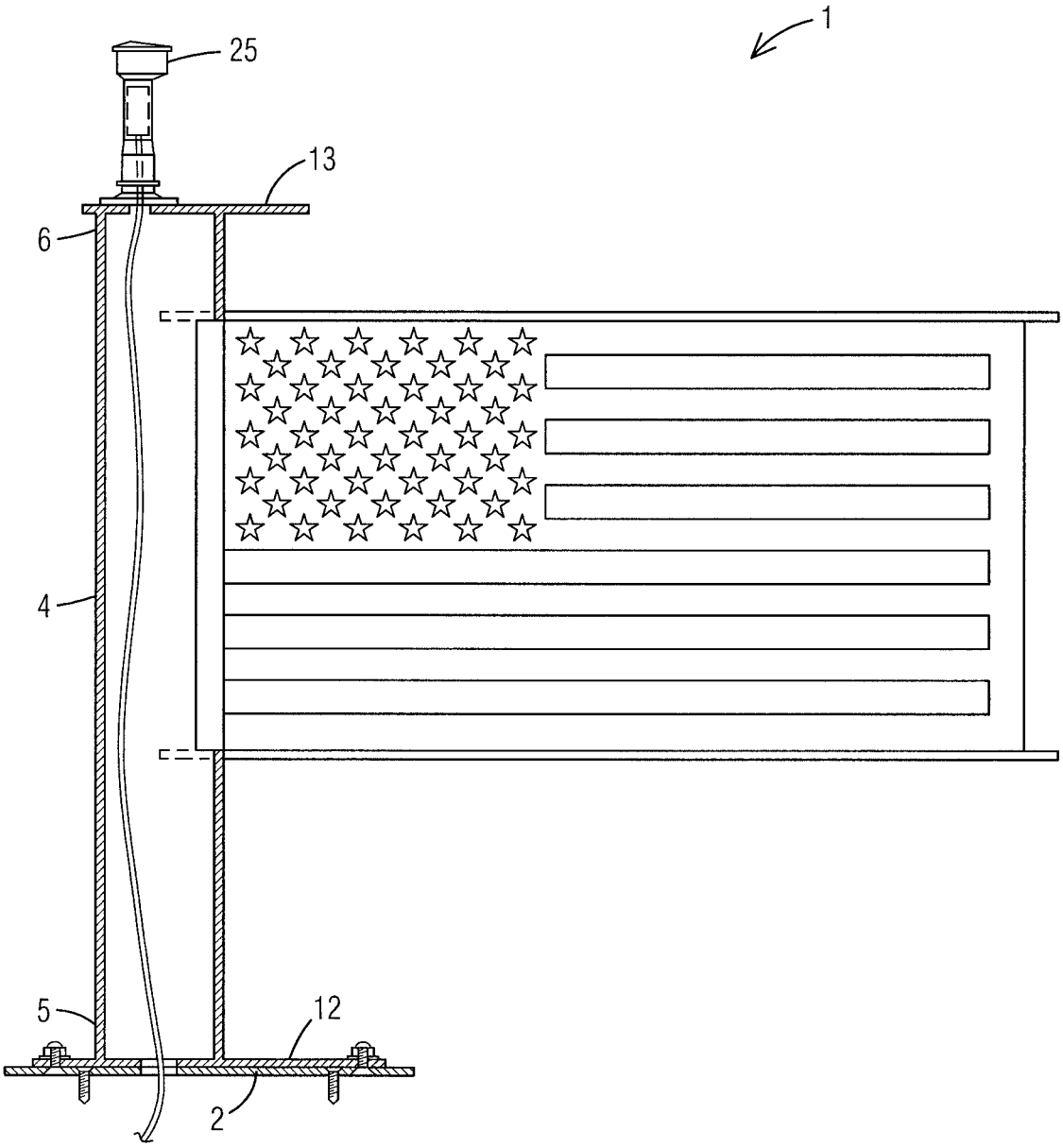
FIG. 12 is a right side plan view of the flag display device thereof.
Figure 13:
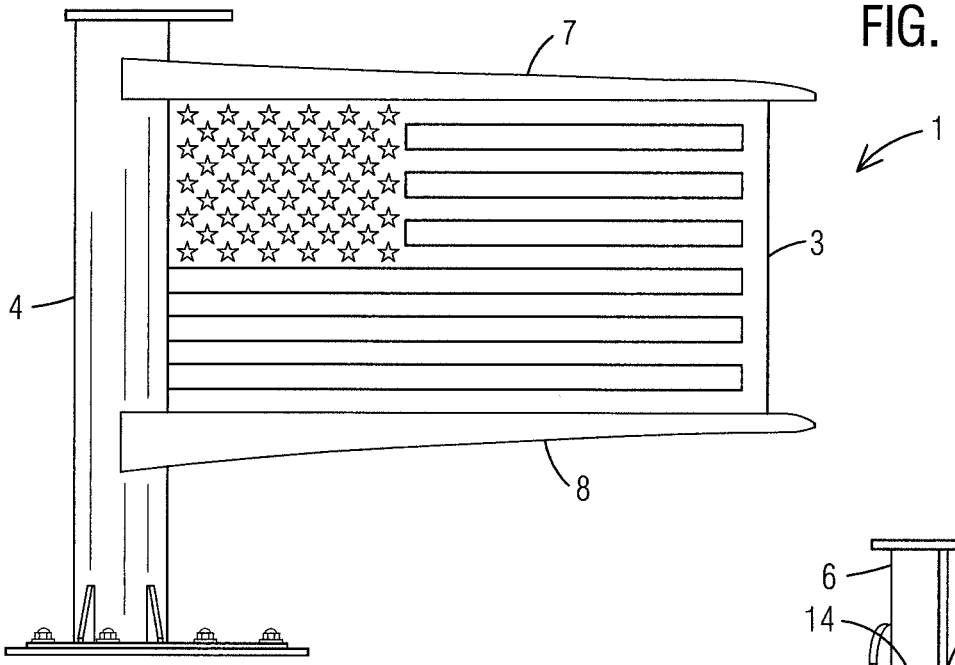
FIG. 13 is a side view of the flag display device of the present invention having an interchangeable panel that is inserted through the top horizontal support arm.
Figure 16:
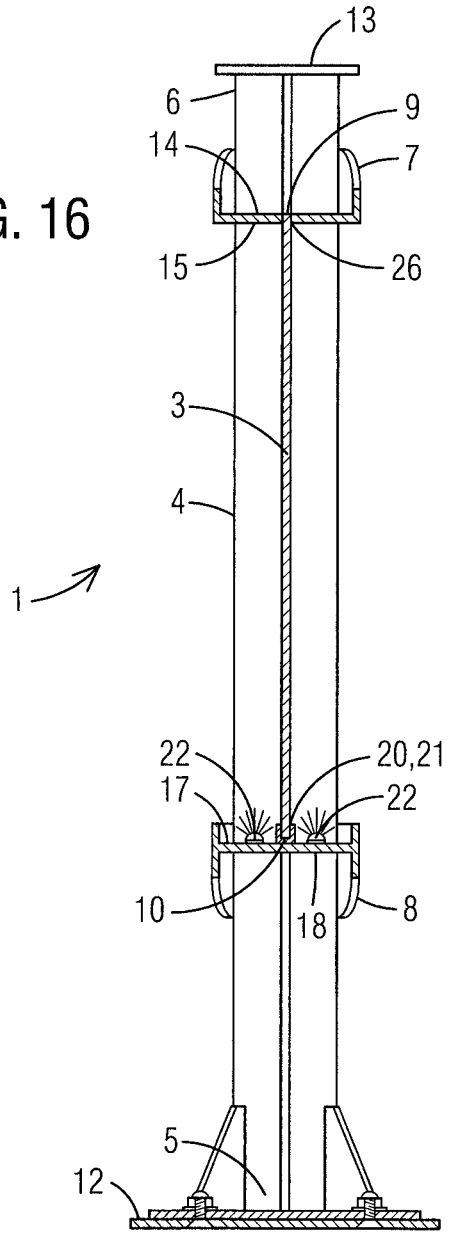
FIG. 16 is a sectional view along lines A-A of FIG. 15.
Figure 14:
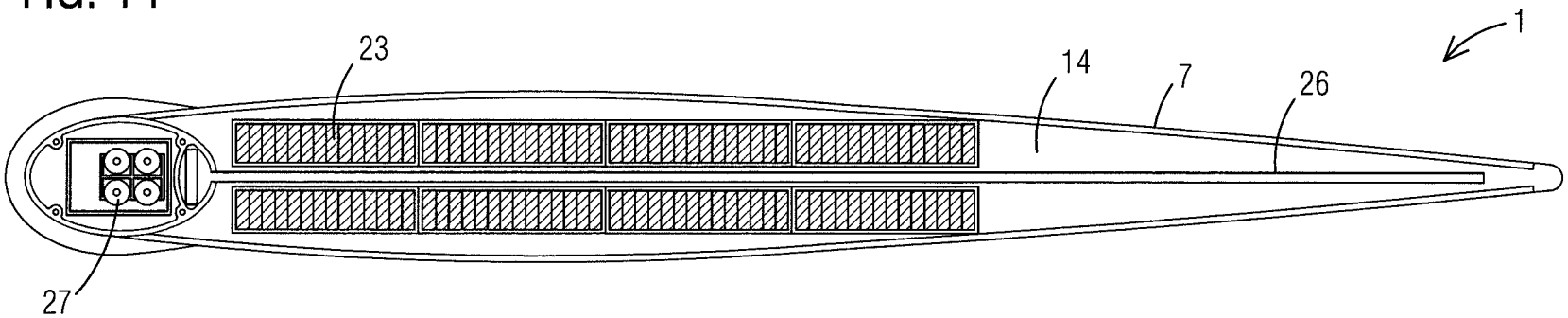
FIG. 14 is a top view of a top horizontal support arm of the flag display device of the present invention.
Figure 15:
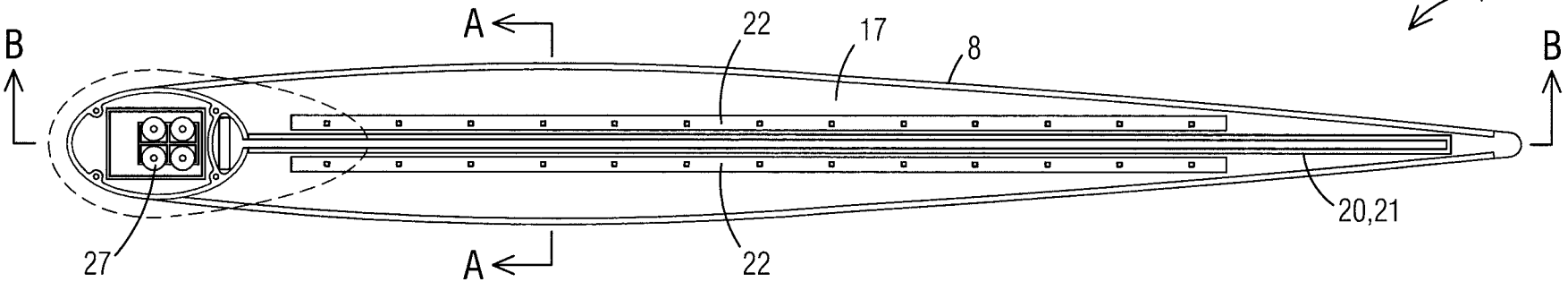
FIG. 15 is a top view of a bottom horizontal support arm of the flag display device of the present invention.
Figure 17:
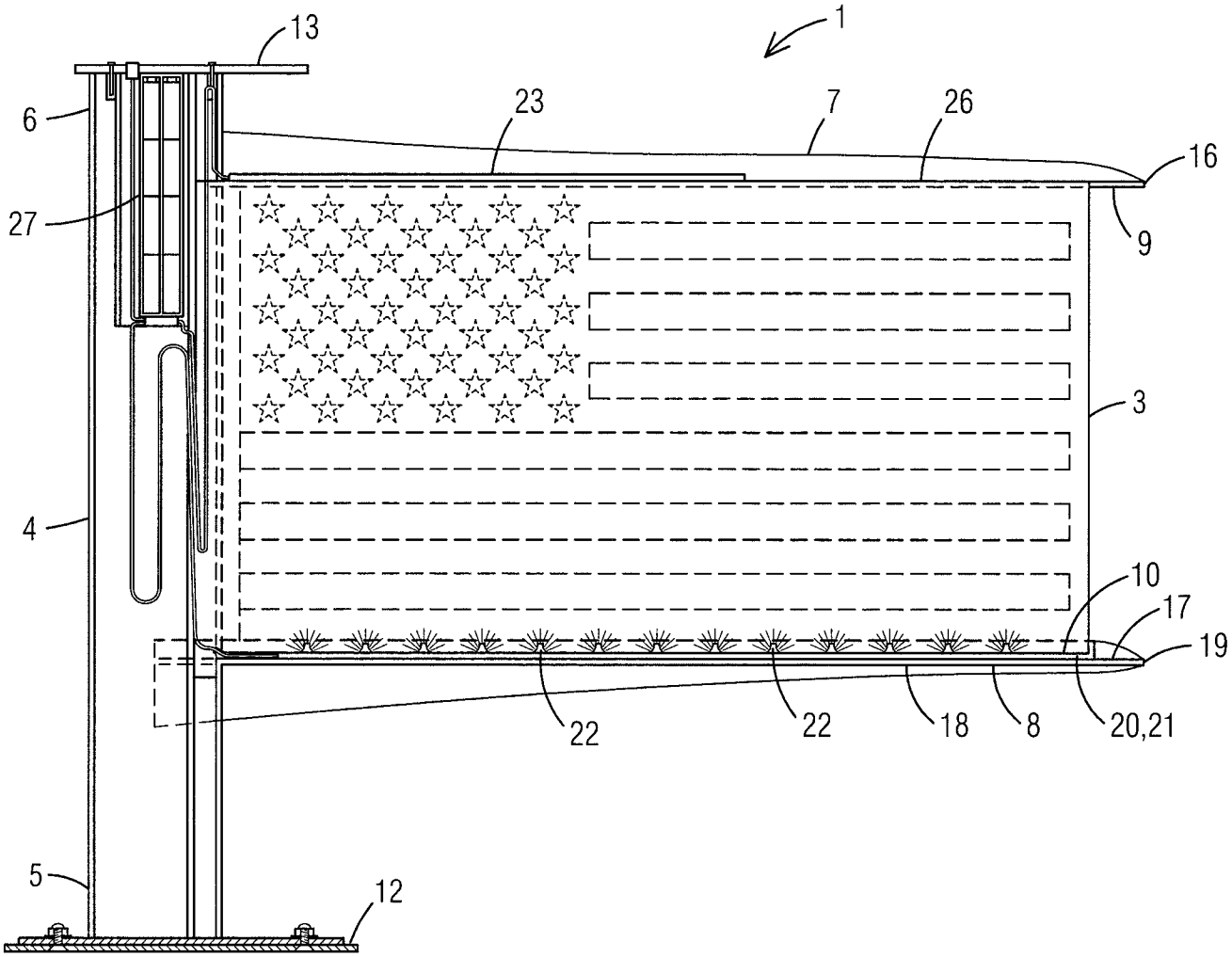
FIG. 17 is a sectional view along lines B-B of FIG. 15.

With reference to FIGS. 9-11, a perspective rear view and a sectional view of an illuminated flag display device 1 of the present invention are illustrated. The flag display device 1 comprises a vertical mast 4 having a bottom end 5 and a top end 6. A bottom mounting plate 12 is preferably located on the bottom end 5 of the vertical mast 4 to provide a means for mounting said vertical mast 4 to a mounting surface, such as a boat 2. A top mounting plate 13, such as a cap, is preferably located on the top end 6 of the vertical mast 4 to provide a means for mounting one or more accessories, to the top end 6 of the vertical mast 4, as illustrated in FIG. 12.

A preferably teardrop-shaped top horizontal support arm 7 having a top surface 14 and a bottom surface 15 extends perpendicularly from the vertical mast 4 below the top end 6 of said vertical mast 4 and terminates at a distal end 16 thereof. Likewise, a preferably teardrop-shaped bottom horizontal support arm 8 having a top surface 17 and a bottom surface 18 extends perpendicularly from the vertical mast 4 below the top horizontal support arm 7 and terminates at a distal end 19 thereof.

At least one display light source 22, such as an LED, may be located on the top horizontal support arm 7 and/or on the bottom horizontal support arm 8. The at least one display light source 22 is preferably located on the bottom surface 15 of the top horizontal support arm 7 and/or the top surface 17 of the bottom horizontal support arm 8. The at least one display light source 22 may be powered by a hard wired energy source and/or a rechargeable battery powered by at least one photovoltaic solar panel 23.

Said at least one display panel 3 is preferably interchangeable and secured to the top horizontal support arm 7, bottom horizontal support arm 8 and/or vertical mast 4 via at least one attachment means 20, such as a u-shaped channel 21 that engages the top edge 9 of the at least one display panel 3 and the bottom edge 10 of the display panel 3, respectively. A retaining means 24, such as a pin, bolt, screw, and do forth may be used to lock the at least one display panel 3 within the channels 21.

With reference to FIG. 12, a right side plan view of the flag display device 1 of the present invention is illustrated. The flag display device 1 comprises a preferably teardrop-shaped vertical mast 4 having a bottom end 5 and a top end 6. A bottom mounting plate 12 is preferably located on the bottom end 5 of the vertical mast 4 to provide a means for mounting said vertical mast 4 to a mounting surface, such as a boat 2. A top mounting plate 13, such as a cap, is preferably located on the top end 6 of the vertical mast 4 to provide a means for mounting one a navigation light 25 or other accessory, such as an antennae and so forth, to the top end 6 of the vertical mast 3. The mast 4 is preferably hollow to allow wiring to be run to the navigation light 25 and/or to the at least one display light source 22.

With reference to FIGS. 13-17, a flag display device 1 of the present invention having an interchangeable display panel 3 that is inserted through the top horizontal support arm 7 is illustrated. The flag display device 1 comprises a vertical mast 4 having a bottom end 5 and a top end 6. A bottom mounting plate 12 is preferably located on the bottom end 5 of the vertical mast 4 to provide a means for mounting said vertical mast 4 to a mounting surface, such as a boat 2. A top mounting plate 13, such as a cap, is preferably located on the top end 6 of the vertical mast 4.

A preferably teardrop-shaped top horizontal support arm 7 having a top surface 14 and a bottom surface 15 extends perpendicularly from the vertical mast 4 below the top end 6 of said vertical mast 4 and terminates at a distal end 16 thereof. Likewise, a preferably teardrop-shaped bottom horizontal support arm 8 having a top surface 17 and a bottom surface 18 extends perpendicularly from the vertical mast 4 below the top horizontal support arm 7 and terminates at a distal end 19 thereof.

At least one display light source 22, such as an LED, may be located on the top horizontal support arm 7 and/or on the bottom horizontal support arm 8. The at least one display light source 22 is preferably located on the bottom surface 15 of the top horizontal support arm 7 and/or the top surface 17 of the bottom horizontal support arm 8. The at least one display light source 22 may be powered by a hard wired energy source and/or at least one rechargeable battery 27 and/or battery pack powered by said at least one photovoltaic solar panel 23.

Said at least one display panel 3 is preferably interchangeable by placing a display panel 3 through a slot 26 located on the top horizontal support arm 7. A top edge 9 of the panel 3 is held in place by the slot 26 while a bottom edge 10 of the panel 3 is held in place by at least one attachment means 20, such as a u-shaped channel 21.

Figure 18:
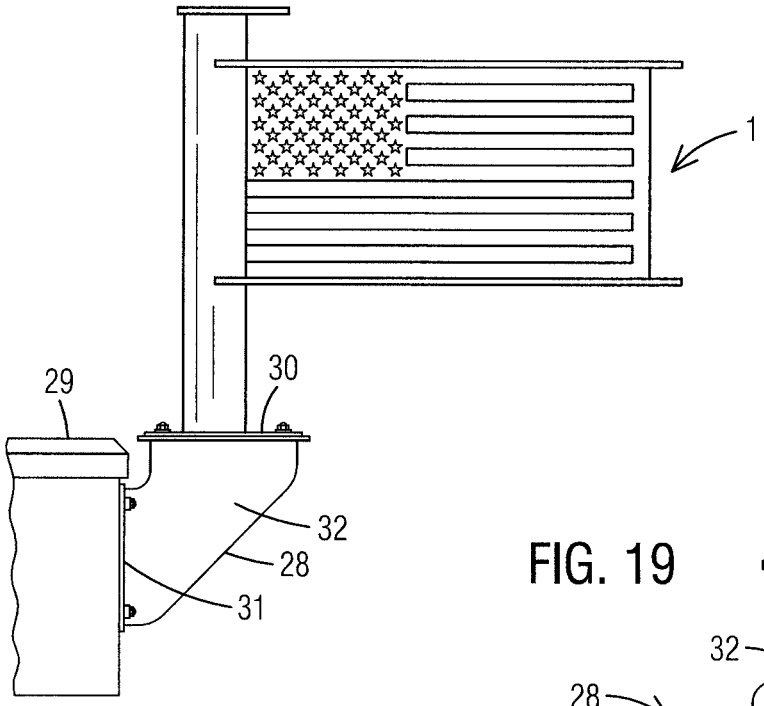
FIG. 18 is a side view of a flag display device of the present invention supported by an L-shaped mounting bracket.
Figure 19:
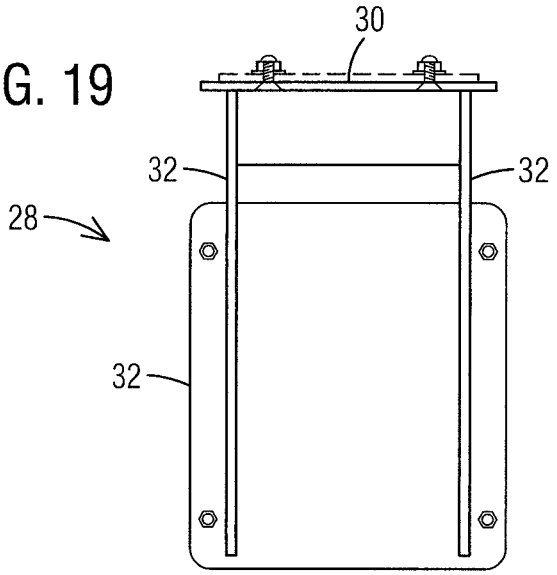
FIG. 19 is a rear view of an L-shaped mounting bracket.

With reference to FIGS. 18 and 19, a side view of a flag display device 1 of the present invention supported by an L-shaped mounting bracket 28 and a rear view of the L-shaped mounting bracket 28, respectively, are illustrated. The flag display device 1 may be mounted to a vertical surface of an object, such as a tool box 29, using the L-shaped bracket 28. Said L-shaped bracket comprises a horizontal plate 30 connected to a vertical plate 31 by at least one support arm 32.

Figure 20:
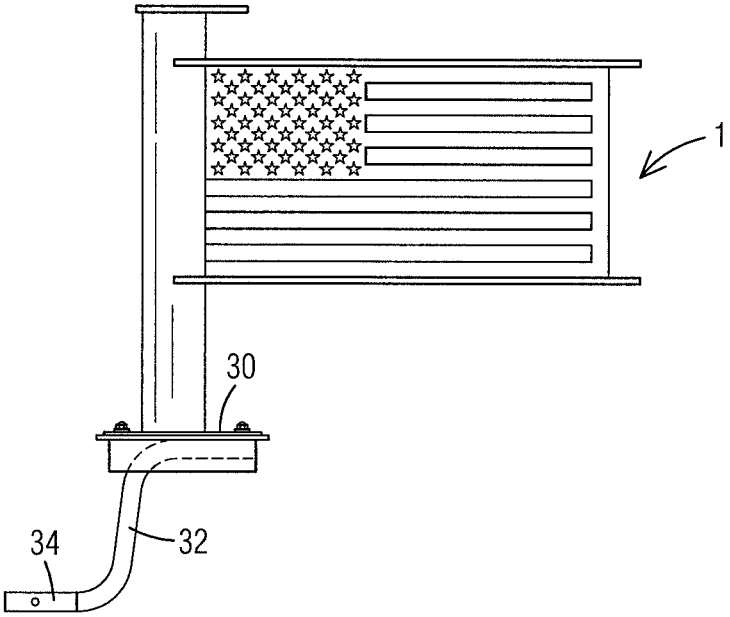
FIG. 20 is a side view of a flag display device of the present invention supported by a trailer hitch bracket.

With reference to FIG. 20, a side view of a flag display device 1 of the present invention supported by a trailer hitch bracket 33 is illustrated. The flag display device 1 may be supported by a hitch receiver using the trailer hitch bracket 33, which comprises a horizontal plate 30 connected to a hitch shank 34 by at least one support arm 32. Said hitch shank 34 engages a hitch receiver and is held in place by a hitch pin.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A flag display device comprising:

an elongated vertical mast having a bottom end and a top end;

said elongated vertical mast having a teardrop-shaped profile when looking down on said top end of said elongated vertical mast;

a top horizontal support arm having a top surface and a bottom surface extending perpendicularly from the vertical mast below the top end of said vertical mast and terminating at a distal end thereof;

a bottom horizontal support arm having a top surface and a bottom surface extending perpendicularly from the vertical mast below the top horizontal support arm and terminating at a distal end;

said top horizontal support arm and said bottom horizontal support arm being parallel to each other and spaced apart to support at least one display panel;

said at least one display panel having a top edge and a bottom edge;

said display panel having a design located thereon;

said top edge of the at least one display panel engaging the bottom surface of the top horizontal support arm;

said bottom edge of the at least one display panel engaging the top surface of the bottom horizontal support arm; and said bottom end of said elongated vertical mast supported by a trailer hitch bracket.

2. The flag display device of claim 1 wherein:

said top edge of the at least one display panel engages the bottom surface of the top horizontal support arm via a slot located on said top horizontal support arm; and said bottom edge of the at least one display panel engages the top surface of the bottom horizontal support arm via at least one channel located on said top horizontal support arm.

3. The flag display device of claim 1 further comprising:

a top mounting plate located on the top end of the vertical mast.

4. The flag display device of claim 1 wherein:

said top horizontal support arm is substantially teardrop-shaped; and said bottom horizontal support arm is substantially teardrop-shaped.

5. The flag display device of claim 1 further comprising:

at least one display light source located thereon for illuminating said at least one display panel.

6. The flag display device of claim 5 wherein:

said at least one display light source if located on said bottom surface of said top horizontal support arm.

7. The flag display device of claim 5 wherein:

said at least one display light source is located on said top surface of said bottom horizontal support arm.

8. The flag display device of claim 5 wherein:

said at least one display light source being connected to a solar panel.

9. A flag display device comprising:

an elongated vertical mast having a bottom end and a top end;

said elongated vertical mast having a teardrop-shaped profile when looking down on said top end of said elongated vertical mast;

a top horizontal support arm having a top surface and a bottom surface extending perpendicularly from the vertical mast below the top end of said vertical mast and terminating at a distal end thereof;

a bottom horizontal support arm having a top surface and a bottom surface extending perpendicularly from the vertical mast below the top horizontal support arm and terminating at a distal end;

said top horizontal support arm and said bottom horizontal support arm being parallel to each other and spaced apart to support at least one display panel;

said at least one display panel having a top edge and a bottom edge;

said display panel having a design located thereon;

said top edge of the at least one display panel engaging the bottom surface of the top horizontal support arm;

said bottom edge of the at least one display panel engaging the top surface of the bottom horizontal support arm; and said bottom end of said elongated vertical mast supported by an L-shaped mounting bracket.

10. The flag display device of claim 9 wherein:

said top edge of the at least one display panel engages the bottom surface of the top horizontal support arm via a slot located on said top horizontal support arm; and said bottom edge of the at least one display panel engages the top surface of the bottom horizontal support arm via at least one channel located on said top horizontal support arm.

11. The flag display device of claim 9 further comprising:

a top mounting plate located on the top end of the vertical mast.

12. The flag display device of claim 9 wherein:

said top horizontal support arm is substantially teardrop-shaped; and said bottom horizontal support arm is substantially teardrop-shaped.

13. The flag display device of claim 9 further comprising:

at least one display light source located thereon for illuminating said at least one display panel.

14. The flag display device of claim 13 wherein:

said at least one display light source if located on said bottom surface of said top horizontal support arm.

15. The flag display device of claim 13 wherein:

said at least one display light source is located on said top surface of said bottom horizontal support arm.

16. The flag display device of claim 13 wherein:

said at least one display light source being connected to a solar panel.

* * * * *